United States Patent [19]

Schibbye

[11] 3,975,123

[45] Aug. 17, 1976

[54] SHAFT SEALS FOR A SCREW COMPRESSOR

[75] Inventor: Lauritz Benedictus Schibbye, Saltsjo-Duvnas, Sweden

[73] Assignee: Svenska Rotor Maskiner Aktiebolag, Nacka, Sweden

[22] Filed: Aug. 19, 1974

[21] Appl. No.: 498,878

[30] Foreign Application Priority Data

Sept. 3, 1973 United Kingdom ..... 41266/73

[52] U.S. Cl. ..... 418/97; 418/102; 418/201; 277/59; 277/70

[51] Int. Cl.[2] ..... F01C 21/02; F01C 21/04; F01C 19/00; F01C 1/16

[58] Field of Search ..... 418/97–100, 418/102, 201–203, 197; 277/59, 70, 71, 72

[56] References Cited

UNITED STATES PATENTS

| | | | |
|---|---|---|---|
| 1,188,189 | 6/1916 | Little | 277/70 |
| 2,971,783 | 2/1961 | Laser | 277/59 |
| 3,265,293 | 8/1966 | Schibbye | 418/100 |
| 3,307,453 | 3/1967 | Nilsson et al. | 418/201 |
| 3,385,514 | 5/1968 | Kilgore et al. | 418/98 |
| 3,556,697 | 1/1971 | Webb et al. | 418/98 |

*Primary Examiner*—John J. Vrablik
*Attorney, Agent, or Firm*—Flynn & Frishauf

[57] ABSTRACT

Dynamic shaft seal system for a screw compressor with water injection comprising a water separator, where pressurized gas from the water separator is supplied around the rotor shafts as a blocking medium.

19 Claims, 4 Drawing Figures

SHAFT SEALS FOR A SCREW COMPRESSOR

The present invention relates to a dynamic shaft seal system for a screw compressor with throttling means in the inlet channel to the working space of the compressor.

In such compressors, running dry or with injection of water or any other liquid that must not mix with the oil lubricating the rotor bearings, it is thus necessary to arrange a drainage area between the main compressor casing and the bearing casing. However a problem then arises to avoid leakage of unfiltered air into the compressor along the rotor shafts under part load conditions when the pressure at least in the low pressure end of the working space is considerably lower than that of the ambient atmosphere. In compressors with liquid injection there is a further problem to avoid leakage of such liquid under normal running conditions along the shafts to the drainage area.

Up to now those sealing problems have been solved by means of different types of direct contact mechanical seals. Those seals, however, have several disadvantages. One of those is the high friction losses which for a compressor having a rotor diameter of the order of 100 mm to 250 mm results in a power loss of about 0.5 to 1 HP for each seal. Another disadvantage is that those mechanical seals are very sensitive and must be mounted very accurately which is costly and time consuming. A third disadvantage is that the mechanical seals during operation are subjected to wear and consequently need regular maintenance in the form of inspection, adjustment and possibly replacement of worn parts.

The main aim of the present invention is to provide a dynamic seal system for solving the problems specified above, which system will at least not result in higher power losses than the mechanical seals earlier used, which system will result in a simpler mounting procedure and which system during operation will be subjected to no wear and consequently will need much fewer inspections and practically no maintenance.

This advantage of no maintenance is especially important as the seal is mounted inside the bearings and in many cases also inside the synchronizing gears of the rotors which must then be removed and mounted once more, which especially with regard to the synchronizing gears is a complicated task requiring a specialist to perform.

SUMMARY OF THE INVENTION

The seal system according to the present invention is a dynamic one using a blocking gas under pressure and comprising means for keeping the pressure on the compressor side of the supply of blocking gas at a certain minimum level to avoid too fast flow of the blocking gas inwardly resulting in an unacceptable suction of unfiltered air from the drainage area into the compressor.

BRIEF DESCRIPTION OF THE DRAWING

The invention will now be described more in detail in connection with a preferred embodiment of a water injected air compressor shown in the accompanying drawings, where.

DETAILED DESCRIPTION OF ILLUSTRATED EMBODIMENTS

Figure 1:
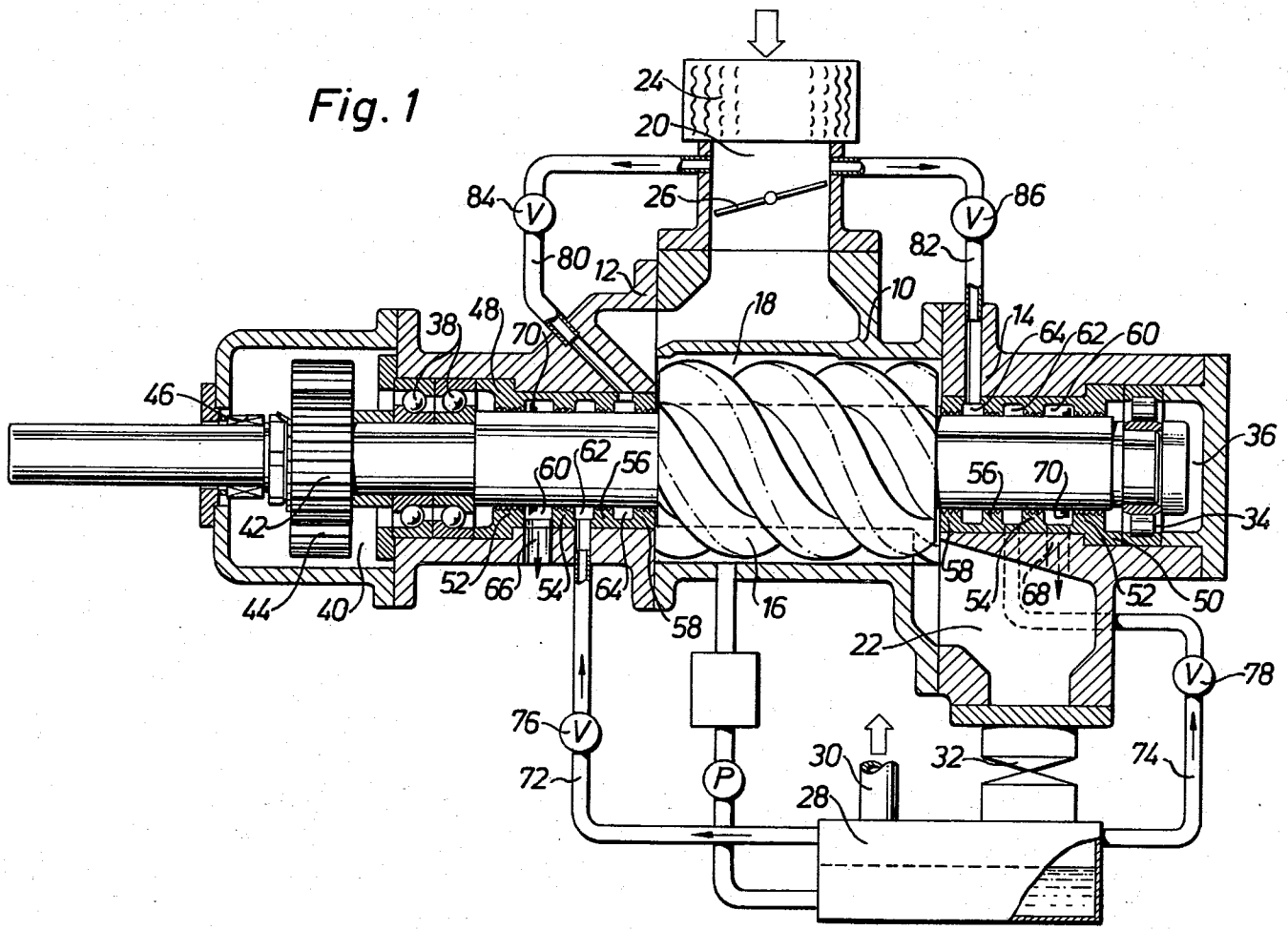
FIG. 1 shows a longitudinal section through a compressor.

The compressor comprises a casing composed of a barrel member 10, a low pressure end plate member 12 and a high pressure end plate member 14, and two intermeshing screw rotors of male and female type of which only the male rotor 16 is shown.

The casing encloses a working space 18 for the rotors, an inlet channel 20 and an outlet channel 22. In the inlet channel 20 are mounted in series an air filter 24 and an adjustable throttling valve 26 for variation of the capacity of the compressor. The outlet channel 22 is connected to a water separator 28 provided with an outlet 30 for compressed air. Between the outlet channel 22 and the water separator 28 a check valve 32 is inserted allowing flow of air in the direction from the outlet channel to the water separator only.

The male rotor 16 is mounted in radial bearings 34 of the roller bearing type mounted within a bearing chamber 36 in the high pressure end plate member 14 and in combined thrust and radial bearings 38 of the ball bearing type mounted within a bearing chamber 40 in the low pressure end plate member 12. This bearing chamber 40 further encloses a synchronizing gear 42 mounted on the male rotor 16 and cooperating with a synchronizing gear 44 mounted on the female rotor. The male rotor is further provided with a stub shaft extending out of the casing through a mechanical seal 46.

Each of the end plate members 12, 14 is between the working space 18 and the bearing chamber 40 and 36, respectively, enclosed therein provided with a bushing 48 and 50, respectively, forming four labyrinth seal sections 52, 54, 56, 58 spaced by three annular chambers 60, 62, 64. The two bushings in the compressor shown are identical in shape and in order to simplify the description the same reference numbers are used for the corresponding details of the two bushings 48, 50. The annular chamber 60 adjacent to the bearing chamber 36, 40 communicates with a drain hole 66, 68 in the end plate member 12, 14 for draining any oil passing over the first labyrinth section 52 from the bearing chamber and any air passing over the second labyrinth section 54. Within the drain chamber 60 the shaft of the rotor passing therethrough is provided with a slinger 70 in order to get all oil thrown away from the surface of the shaft. The intermediate annular chamber 62 communicates through a pipe 72, 74 with the gas side of the water separator 28 for admission of pressurized air to the chamber 62. In each of the pipes 72, 74 a throttling valve 76, 78 is inserted in order to adjust the pressure of the air supplied to the chamber 62 in a way explained later. The third annular chamber 64 located adjacent to the working space 18 communicates through a pipe 80, 82 with the inlet channel 20 of the compressor within the section thereof located between the air filter 24 and the capacity varying throttle valve 26. In each of the pipes 80, 82 a check valve 84, 86 is inserted which allows flow in the direction from the inlet channel 20 to the third annular chamber 64 only.

The sealing system according to the invention functions in the following way.

At normal full capacity operation of the compressor the pressure in the working space 18 is so high at both axial ends thereof that the pressures in the annular chambers 64 owing to the leakage over the seal sections 58 is higher than that in the inlet channel 20 which is practically the same as the atmospheric pressure. the check valves 84, 86 are consequently closed so that no air can flow through the pipes 80, 82. In order to avoid leakage from the working space along the rotor shafts to the drain chambers 60 the pressure in the intermediate chambers 62 enclosing blocking air must then be higher than that in the corresponding chamber 64. The pressure of the blocking air is determined by the position in which the corresponding throttle valve 76, 78 is set. This blocking air pressure should be high enough to guarantee a certain flow over the seal section 56 from the intermediate chamber 62 to the third chamber 64 and further to guarantee that the flow if any over the seal section 58 is from the third chamber 64 to the working space 18 so that no leakage of water can take place from the working space. Simultaneously, blocking air flows over the seal section 54 from the intermediate chamber 62 to the drain chamber 60. In order to minimize the losses of blocking air which means a power loss of the compressor plant, as already compressed air is used for the blocking purposes, the throttle valves 76, 78 should be set in positions to give high enough blocking air pressures to guarantee the function described above. Normally it is enough to adjust the blocking air pressure so that the pressure difference to that in the corresponding third chamber 64 if no blocking air was available amounts only to about 10% of the normal atmospheric pressure.

When the compressor is operating under part load with the capacity controlling throttle valve 26 closed the conditions are quite different. The pressure in the inlet channel 20 after the throttle valve 26 may be as low as 10% of the atmospheric pressure resulting in subatmospheric pressure in the working space 18 at both axial ends thereof, especially at the low pressure end. The leakage would then be from the drain chamber 60 to the working space 18 resulting in introduction of unfiltered air into the compressor which cannot be tolerated. The admittance of blocking air to the intermediate chamber 62 at a pressure only slightly higher than that in the drain chamber 60 will then not be enough, as the speed of flow over the seal sections 56, 58 would be so high that real pressure in the intermediate chamber 62 would be lower than that in the drain chamber 60 resulting in an unacceptable flow of unfiltered air over the seal section 54 from the drain chamber 60 to the intermediate chamber 62 and from there further on to the working space 18. This function is, according to the present invention, avoided by means of the third chamber 64 and its communication with the inlet channel 20 through the pipe 80, 82. When the pressure in this third chamber 64 drops below that in the inlet channel 20 the valve 84, 86 will open up the communication through the pipe 80, 82 so that the pressure in the third chamber 64 will be practically the same as in the inlet channel 20 and consequently also practically the same as in the drain chamber 60. The speed of flow over the seal section 56 will then be reduced to such an amount that the pressure in the intermediate chamber 62 is always kept somewhat higher than that in the drain chamber 60 so that a certain positive flow over the seal section 54 always takes place in the direction from the intermediate chamber 62 to the drain chamber 60, whereby any supply of unfiltered air to the working space 18 is positively avoided. In certain applications at least one of the check valves 84, 86 may be dispensed with in order to reduce the pressure of the blocking air and consequently the amount of air leaking over the seal section 54 to the drain chamber 60.

Figure 2:
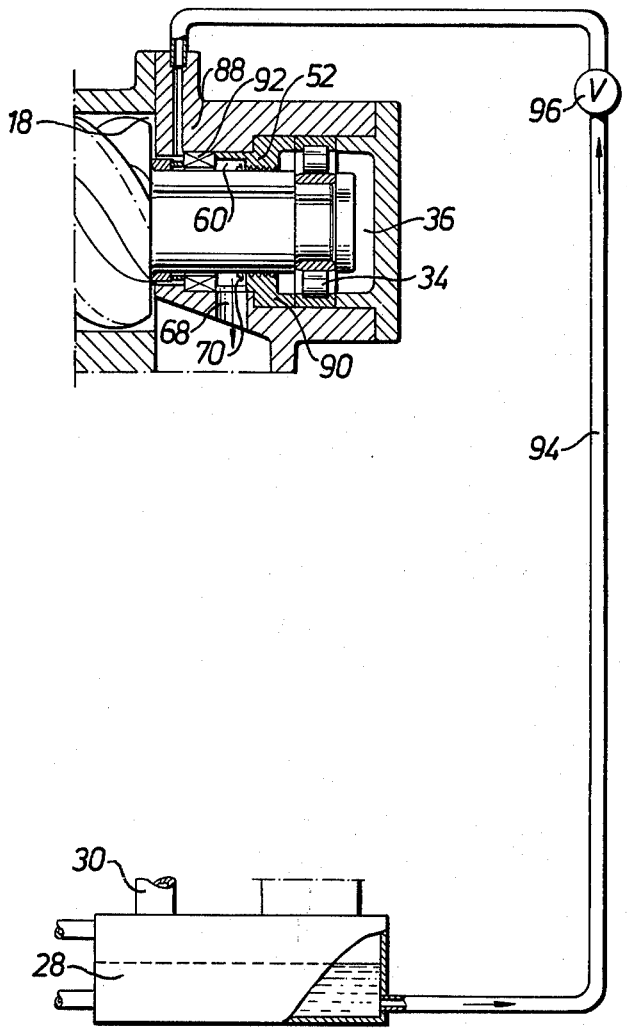
FIG. 2 shows a detail view similar to FIG. 1 of a somewhat modified compressor.

The modified compressor shown in FIG. 2 differs from the one shown in FIG. 1 only with regard to the shape of the high pressure end plate member and especially the shaft seals disposed therein.

The casing is provided with a high pressure end plate member 88 providing a bearing chamber 36 enclosing the radial bearings 34 in the same way as shown in FIG. 1. The bushing 50 of FIG. 1 is replaced by a bushing 90 providing a seal section 52 and a drain chamber 60 communicating with a drain hole 68 similarly to that in FIG. 1, and a mechanical contact seal 92. The space between the mechanical seal 92 and the working space 18 communicates through a pipe 94 with the water side of the water separator 28. In this pipe 94 a throttle valve 96 is inserted to reduce the pressure and the speed of flow in an appropriate way. This modification may be used when the power losses owing to the amount of pressure air lost in the dynamic sealing system should considerably exceed the power losses obtained by friction in the corresponding mechanical seal.

Figure 3:
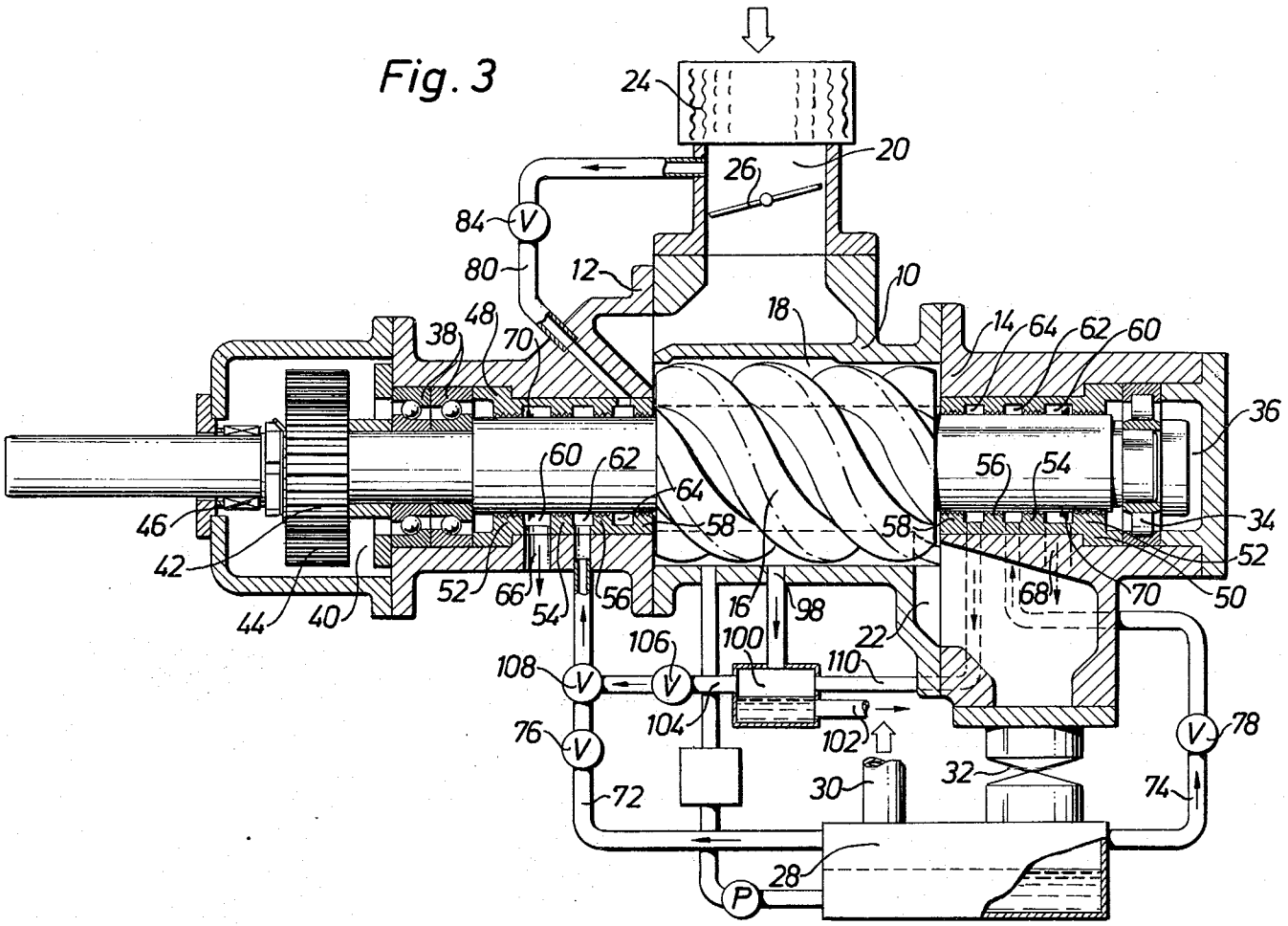
FIG. 3 shows a longitudinal section through a third embodiment.

The compressor shown in FIG. 3 differs from the one shown in FIG. 1 in that the working space 18 is provided with a further port 98 within an area of the working space where the pressure under full load conditions is about 1.2 ata. This further port 98 communicates with a second water separator 100 from which water is drained to the compressor inlet through a channel 102. The gas side of the second water separator communicates through a channel 104 with a throttle valve 106, with a three-way valve 108 inserted in the pipe 72 between the throttle valve 76 and the annular chamber 62. The gas side of the second water separator 100 communicates further through a channel 110 with the annular chamber 64 whereas the pipe 82 and the check valve 86 are omitted.

The function differs from the one according to FIG. 1 in the following way.

Under normal full load capacity the blocking air to the annular chamber 62 on the low pressure side is taken from the second water separator 100 where there is a pressure of about 1.2 ata instead of from the water separator 28 where there is a pressure of about 7–8 ata which means that the power for compression of the blocking air is considerably reduced. On the high pressure side the annular chamber 64 is drained to the second water separator 100 so that the pressure in the annular chamber will not exceed about 1.2 ata which means that the pressure in the annular chamber 62 can be reduced and consequently also that the leakage from the annular chamber 62 to the drain chamber 60 is decreased resulting in a smaller loss of compressed gas, i.e. a smaller power loss.

Under part load conditions the sealing system functions principally in the same way as according to FIG. 1. However, as noted above the pressure of the blocking gas on the pressure side is kept lower and consequently also under those conditions the power loss is reduced.

Figure 4:
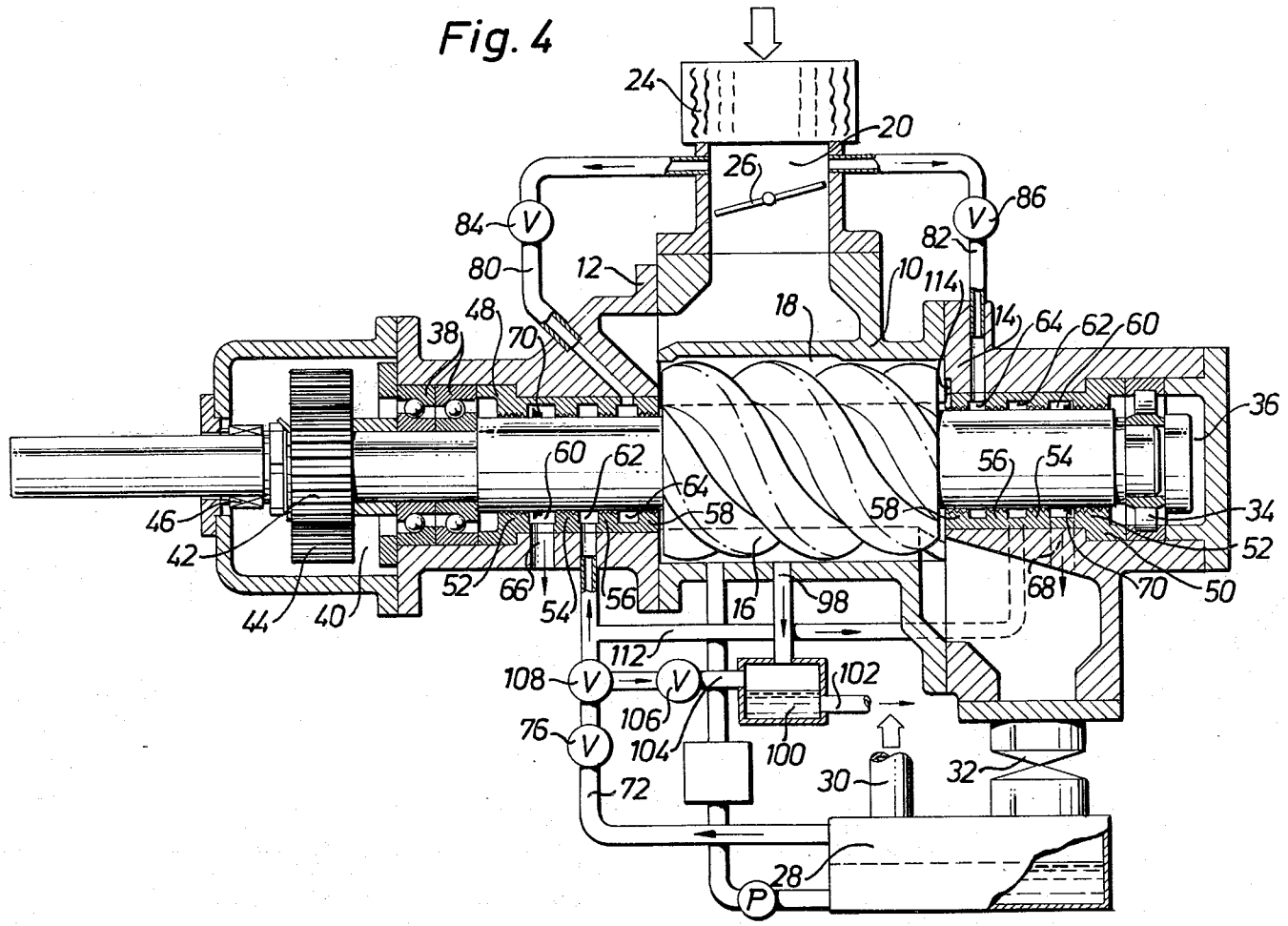
FIG. 4 shows a longitudinal section through a fourth embodiment.

The compressor shown in FIG. 4 differs from the one shown in FIG. 1 in that the pipe 74 with its throttle valve 78 and the channel 110 are omitted, that the pipe 82 with its check valve 86 of FIG. 1 is once more inserted, and that the pipe 72 between the three-way valve 108 and the annular chamber 62 through a channel 112 communicates with the annular chamber 62 on the high pressure side. The end of the high pressure end bushing 50 facing the working space 18 is further through a channel 114 in communication with the low pressure side of the compressor.

With regard to the function the following details are pointed out.

On the low pressure side the function is exactly the same as according to FIG. 3 under normal full load conditions as well as under part load conditions.

With regard to the high pressure side the function is practically the same as on the low pressure side which means that the pressure of the blocking gas is further reduced from the embodiment shown in FIG. 3 resulting in a further decrease of the power loss.

I claim:

1. In a screw compressor comprising a housing (10) defining a working space (18) containing a pair of intermeshing male and female screw rotors, the screw rotors being mounted in said housing (10) by means of respective rotor shaft means, said housing (10) further defining respective bearing chambers which are supplied with lubricant and into which said respective rotor shaft means extend; an inlet channel (20); an outlet channel (22); and port means in said housing communicating each of said inlet and outlet channels with the working space (18) of the housing, the improvement comprising:

at least one shaft seal system associated with at least one of said rotor shaft means, each shaft seal system including:

a pressure gas source means including at least a first pressure gas source (28), and means including port means in said working space for communicating said first pressure gas source with the high pressure side of the working space; and four spaced seal sections (58,56,54,52) mounted with a positive clearance relative to an associated rotor shaft means;

an annular intermediate pressure chamber (64) being defined between the first (58) and second (56) seal sections, an annular blocking pressure chamber (62) being defined between the second (56) and third (54) seal sections and being in communication with said first pressure gas source (28), and a drain space (60) defined between the third (54) and the fourth (52) seal sections;

said first seal section (58) being disposed between the working space (18) of the compressor and the intermediate pressure chamber (64), the second seal section (56) being disposed between the intermediate pressure chamber (64) and the blocking pressure chamber (62), the third seal section (54) being disposed between the blocking pressure chamber (62) and the drainage space (60), and the fourth seal section (52) being disposed between the drainage space (60) and the bearing chamber (36,40) of the related shaft means; and means for communicating said first pressure gas source (28) with said blocking chamber (62);

said drain space draining away any lubricant from the bearing chamber passing over the fourth seal section and any gas passing over the third seal section.

2. System according to claim 1 wherein said rotor shaft means include respective bearings disposed on the ends thereof with the shaft seal systems interposed between said working space and said bearings, said respective bearing chambers receiving said bearings therein.

3. System according to claim 1 including one of said shaft seal systems on each end rotor shaft means of each of said rotors.

4. System according to claim 1 wherein each of said seal sections comprises an annular member projecting from a respective rotor shaft means and spaced from an adjacent seal section axially along said rotor shaft means.

5. System according to claim 1 wherein said lubricant is oil.

6. System according to claim 1 wherein said compressor is a water injection compressor.

7. System according to claim 6 wherein said pressure gas source means comprises a water separator.

8. System according to claim 1 wherein:

said inlet channel includes a capacity controlling valve provided therein;

the intermediate pressure chamber through a channel is in communication with the inlet channel ahead of the capacity controlling valve;

means is provided for allowing gas flow only in the direction from the inlet channel to said intermediate pressure chamber;

said first pressure gas source (28) is in communication with the high pressure side of the compressor; and said pressure gas source means further includes means for pressure reduction provided between said first pressure gas source (28) and the blocking chamber (62).

9. System according to claim 8 wherein said port means includes a further port in the compressor, and said pressure gas source means includes:

a second pressure gas source in communication with said further port in the compressor, said further port being located within an area for an intermediate pressure;

a three-way valve coupled between the pressure reduction means and the blocking chamber; and a channel communicating said second pressure gas source with said three-way valve, said last-mentioned channel being provided with means for pressure reduction.

10. System according to claim 9 wherein:

said three-way valve is in communication with the blocking chamber at the low pressure end of the compressor;

said pressure gas source means includes a further pressure reduction means, the blocking chamber at the high pressure end being in communication with the first pressure gas source via said further pressure reduction means; and the intermediate pressure chamber at the high pressure end is in communication with the second gas source.

11. System according to claim 9 wherein:

said three-way valve is in communication with the blocking chambers at both ends of the compressor; and the end facing the working space of the first seal section at the high pressure end of the compressor is in communication with the low pressure side of the compressor.

12. In a screw compressor comprising a housing (10) defining a working space (18) containing a pair of intermeshing male and female screw rotors, the screw rotors being mounted in said housing (10) by means of respective rotor shaft means; an inlet channel (20); an outlet channel (22); and port means in said housing communicating each of said inlet and outlet channels with the working space (18) of the housing, the improvement comprising:

at least one shaft seal system associated with at least one of said rotor shaft means, each shaft seal system including:

a pressure gas source means including at least a first pressure gas source (28); and at least three spaced seal sections (58,56,54) mounted with a positive clearance relative to an associated rotor shaft means;

an annular intermediate pressure chamber (64) being defined between the first (58) and second (56) seal sections, an annular blocking pressure chamber (62) being defined between the second (56) and third (54) seal sections and being in communication with said first pressure gas source (28), and a drain space (60) defined at least in part by the third seal section (54);

said first seal section (58) being disposed between the working space (18) of the compressor and the intermediate pressure chamber (64), the second seal section (56) being disposed between the intermediate pressure chamber (64) and the blocking pressure chamber (62), and the third seal section (54) being disposed between the blocking pressure chamber (62) and the drainage space (60);

port means in said compressor communicating said pressure gas source (28) with a blocking pressure chamber and with the high pressure side of the compressor;

a capacity controlling valve provided in the inlet channel of the compressor;

channel means communicating the intermediate pressure chamber with the inlet channel ahead of the capacity controlling valve; and means for allowing gas flow only in the direction from the inlet channel to said intermediate pressure chamber;

said pressure gas source means further including means for pressure reduction provided between said first pressure gas source (28) and the blocking chamber (62).

13. System according to claim 12 wherein said port means includes a further port in the compressor, and said pressure gas source means includes:

a second pressure gas source in communication with said further port in the compressor, said further port being located within an area for an intermediate pressure;

a three-way valve coupled between the pressure reduction means and the blocking chamber; and a channel communicating said second pressure gas source with said three-way valve, said last-mentioned channel being provided with means for pressure reduction.

14. System according to claim 13 wherein:

said three-way valve is in communication with the blocking chamber at the low pressure end of the compressor;

said pressure gas source means includes a further pressure reduction means, the blocking chamber at the high pressure end being in communication with the first pressure gas source via said further pressure reduction means; and the intermediate pressure chamber at the high pressure end is in communication with the second gas source.

15. System according to claim 13 wherein:

said three-way valve is in communication with the blocking chambers at both ends of the compressor; and the end facing the working space of the first seal section at the high pressure end of the compressor is in communication with the low pressure side of the compressor.

16. System according to claim 12 wherein said compressor is a water injection compressor.

17. System according to claim 16 wherein said pressure gas source (28) comprises a water separator.

18. System according to claim 12 wherein said at least three seal sections includes a fourth seal section (52) spaced from said third seal section (54) and having a positive clearance relative to an associated rotor shaft means, the drain space (60) being defined between the third (54) and fourth (52) seal sections.

19. System according to claim 18 wherein said rotor shaft means include a bearing disposed on the ends thereof with the shaft seal systems interposed between said working space and said bearings, and said housing includes respective bearing chambers for receiving said bearings, said fourth seal section being interposed between the bearing chamber of the respective rotor shaft means and the drain space, said drain space draining any oil from the bearing chamber passing over the fourth seal section and any air passing over the third seal section.

* * * * *